US006292150B1

(12) United States Patent
Doi et al.

(10) Patent No.: US 6,292,150 B1
(45) Date of Patent: Sep. 18, 2001

(54) GLASS ANTENNA DEVICE

(75) Inventors: Ryokichi Doi; Hitoshi Kakizawa, both of Osaka (JP)

(73) Assignee: Nippon Sheet Glass Co., Ltd., Osaka (JP)

( * ) Notice: Subject to any disclaimer, the term of this patent is extended or adjusted under 35 U.S.C. 154(b) by 0 days.

(21) Appl. No.: 09/636,327

(22) Filed: Aug. 10, 2000

(30) Foreign Application Priority Data

Aug. 23, 1999 (JP) ..... 11-235604

(51) Int. Cl.[7] ..... H01Q 1/32
(52) U.S. Cl. ..... 343/713; 343/846
(58) Field of Search ..... 343/711, 712, 343/713, 846, 848, 906

(56) References Cited

U.S. PATENT DOCUMENTS 5,255,002 * 10/1993 Day ..... 343/713
5,268,700 * 12/1993 Hirotsu et al. ..... 343/713
5,293,174 * 3/1994 Kropielnicki et al. ..... 343/713
5,353,039 * 10/1994 Tsukada et al. ..... 343/713
5,406,295 * 4/1995 Baranski et al. ..... 343/713
5,479,179 12/1995 Hirotsu et al. ..... 343/700 MS
5,499,034 * 3/1996 Fujii et al. ..... 343/713
5,657,029 * 8/1997 Iijima et al. ..... 343/713

FOREIGN PATENT DOCUMENTS 6-53721 2/1994 (JP) .
8-130404 5/1996 (JP) .

* cited by examiner

*Primary Examiner*—Tan Ho
(74) *Attorney, Agent, or Firm*—Merchant & Gould P.C.

(57) ABSTRACT

The invention provides a glass antenna device having a ground pattern, which has a stable antenna performance regardless of the position of a coaxial cable. The glass antenna device is mounted on a fixed window of a vehicle, and comprises an antenna including a radiation pattern and a ground pattern. The radiation pattern is connected to the inner conductor of a coaxial cable. The ground pattern is coupled capacitively with the vehicle, and further is connected to the outer conductor of the coaxial cable in at least two connecting portions.

7 Claims, 8 Drawing Sheets

GLASS ANTENNA DEVICE

FIELD OF THE INVENTION

The present invention relates to a glass antenna device for vehicles, particularly to a feeding structure in the glass antenna device.

BACKGROUND OF THE INVENTION

Glass antenna devices mounted on a vehicle window have been used widely to receive amplitude modulation waves or frequency modulation waves. Furthermore, glass antennas are beginning to be used as well as rod antennas for mobile communications (automobile telephones).

FIG. 8 shows a conventional antenna device 101 for automobile telephones (e.g. for an 800 MHz band). The antenna device 101 comprises antenna patterns 111 and 112 formed on a rear window glass 105, a coaxial cable 102, and a receiver transmitter (not shown).

The substantially linear radiation pattern 111 is connected to a core 121 that is the inner conductor of the coaxial cable 102. Furthermore, the ground pattern 112 is arranged so that its one edge becomes parallel to and in close proximity to the vehicle body 104, so that it can be coupled capacitively with the vehicle body 104. Furthermore, a braided wire that is the outer conductor of the coaxial cable is connected and fixed to the ground pattern with a presser metallic terminal 103. Thus, the antenna device is grounded to the vehicle body 104 via the ground pattern.

In such an antenna device, however, grounding by the ground pattern is not perfect. Thus, a potential difference may be generated between the ground pattern and the coaxial cable. With this potential difference, a current may flow from the ground pattern to the coaxial cable. This current causes radiation of waves from the coaxial cable. That is, the coaxial cable acts like an antenna.

Thus, in this antenna device, the antenna performance changes when the coaxial cable is turned around, that is the position of the coaxial cable is changed, as if the antenna itself is moved.

Accordingly, in this antenna device, it has been necessary to adjust the antenna taking the instability in the antenna performance due to the position of the coaxial cable into consideration. Thus, considerable time has been required to adjust such an antenna device entirely.

On the other hand, JP-A-6-53721 discloses a connecting structure of a glass antenna, particularly a structure in which the outer conductor of a coaxial cable is connected to a ring by soldering. JP-A-8-130404 also discloses another connecting structure of a glass antenna.

Because the outer conductor of the coaxial cable is connected to the ring by soldering, the glass antennas disclosed in the above-mentioned publications have good electrical connections.

However, even with this structure, the problem of generation of a potential difference between the ground pattern and the coaxial cable remains.

Moreover, positioning the coaxial cable in a vehicle may be restricted depending on the vehicle shape or the location at which the antenna device is mounted. The antenna performance may become poor with the turning that is allowed.

SUMMARY OF THE INVENTION

Thus, it is an object of the present invention to provide a glass antenna device having a ground pattern, which has a stable antenna performance regardless of the position of a coaxial cable.

Furthermore, it is another object of the present invention to provide a glass antenna device whose mounting is unlikely to be restricted by turning of a coaxial cable.

In order to solve the above-mentioned problems, the present invention provides a glass antenna device mounted on a fixed window of a vehicle, comprising a radiation pattern and a ground pattern, the radiation pattern being connected to an inner conductor of a coaxial cable, the ground pattern being coupled capacitively with a body of the vehicle and further being connected to an outer conductor of the coaxial cable in at least two connecting portions.

In the antenna device of the present invention, it is preferable that a distance between two adjacent portions selected from the connecting portions is at least $\lambda/4$, where $\lambda$ is a wavelength that is received or transmitted by the antenna device. Thus an antenna device can be provided in which the potential coupling between the ground pattern and the coaxial cable is further ensured, and in which the antenna performance is stabilized.

In the antenna device of the present invention, it is preferable that a number of the connecting portions is two. Thus, an increase in the number of the assembly steps resulting from the increased connecting portions can be minimized, while the stability in the antenna performance is ensured.

In the antenna device of the present invention, it is preferable that a number of the connecting portions is three. Thus an antenna device can be provided in which the potential coupling between the ground pattern and the coaxial cable is further ensured, and in which the antenna performance is further stabilized.

In the antenna device of the present invention, it is preferable that the ground pattern has a length of at least $\lambda/2$, where $\lambda$ is a wavelength that is received or transmitted by the antenna device.

The present invention is characterized in that the ground pattern is connected to the outer conductor of the coaxial cable in at least two connecting portions. This structure can ensure potential coupling between the ground pattern and the coaxial cable, so that the influence of the imperfect grounding by the ground pattern can be reduced. Moreover, by making the distance between the adjacent connecting portions at least $\lambda/4$, the influence of the imperfect grounding can be further reduced.

Thus, the present invention has an effect that the antenna performance is not affected by the position at which the coaxial cable is laid in a vehicle.

That is, the region of the coaxial cable from the last of the connecting portions can be positioned without particular restrictions. Thus, the glass antenna device can be mounted to a vehicle regardless of the vehicle design or the location at which it is mounted. Moreover, the last connecting portion herein refers to the connecting portion that is the farthest from the radiation pattern.

Moreover, when the distance between the adjacent connecting portions is less than $\lambda/4$, the potential of the ground pattern might be increased, which may lead to difficulty in feeding. Thus, it is preferable that the distance between the adjacent connecting portions is at least $\lambda/4$.

PREFERRED EMBODIMENTS OF THE INVENTION

The following is a more detailed explanation of the preferred embodiments of the present invention with reference to the accompanying drawings.

First Embodiment

Figure 1:
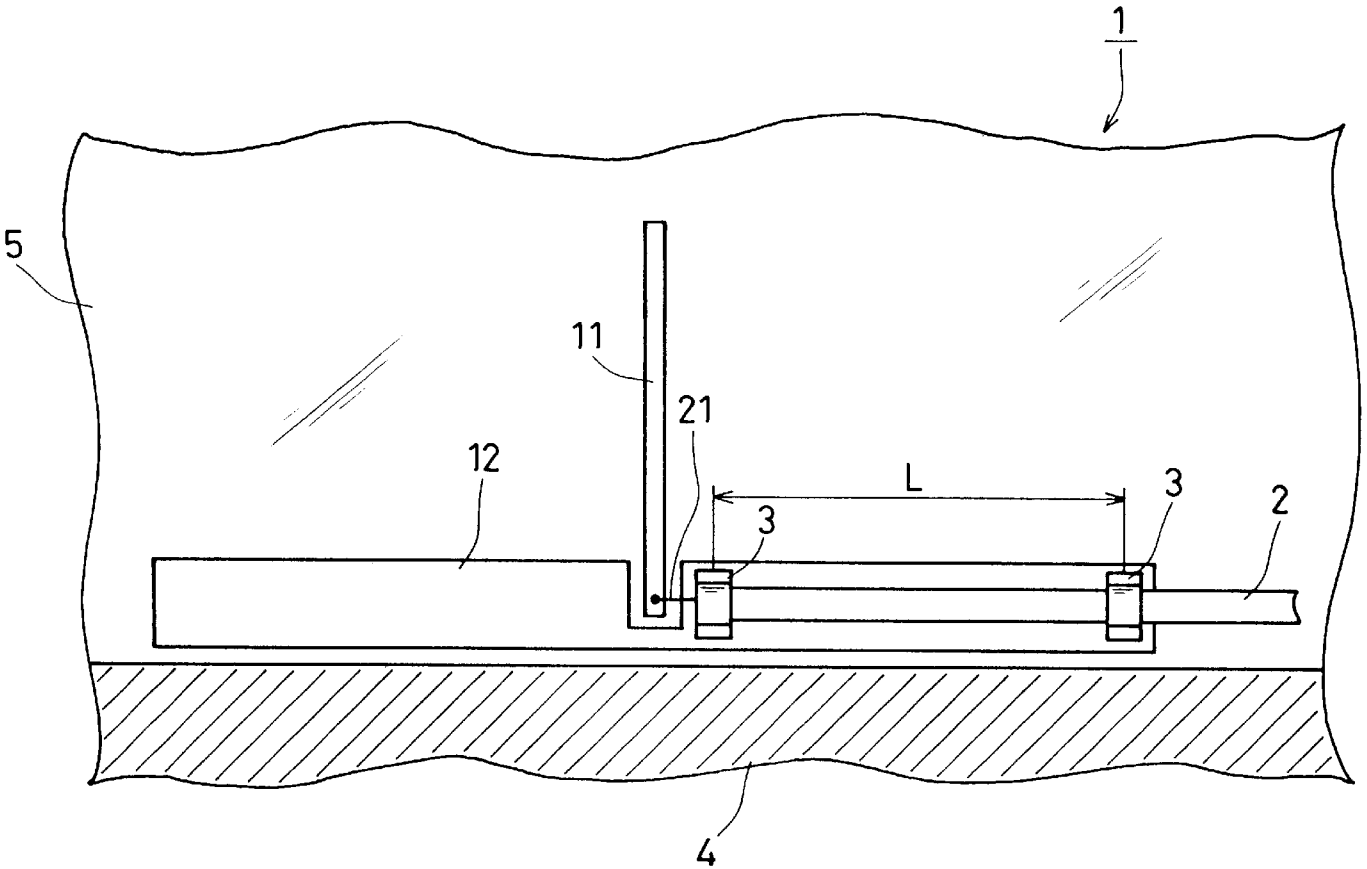
FIG. 1 is a plan view showing a first embodiment of the antenna device according to the present invention.

FIG. 1 is a schematic illustration of an antenna device 1 that is a first embodiment of the present invention.

An antenna device 1 is mounted along the lower edge of a rear window glass 5. A radiation pattern 11 is a linear pattern having a length of substantially $\lambda/4$, and is connected to a core 21 that is the inner conductor of a coaxial cable 2. A ground pattern 12 is a band-shaped pattern that has a relief portion (a recessed portion) surrounding an edge portion of the radiation pattern 11. The ground pattern has a length of substantially $\lambda/2$, where $\lambda$ is the center wavelength that is received and transmitted.

Specifically, the wavelength $\lambda$ is about 400 mm in the case of an 800 MHz band, and about 200 mm in the case of a 1.5 GHz band.

The ground pattern 12 and a braided wire that is the outer conductor of the coaxial cable 2 are connected and fixed with two metallic terminals 3, 3 spaced at a distance L of substantially $\lambda/4$. The metallic terminals 3, 3 are soldered to the ground pattern 12. The outer sheath of the coaxial cable is peeled off in the portions corresponding to the metallic terminals 3, 3 so that it is electrically connected to the metallic terminals 3, 3. Moreover, the coaxial cable 2 is connected to a receiver and transmitter, which is not shown in the drawing.

In this antenna device, a change in the antenna performance when the coaxial cable was turned around and positioned differently was investigated with varied frequencies from 800 MHz to 1 GHz. The change in the antenna performance was evaluated by a network analyzer. Moreover, the smaller the change in VSWR (Voltage Standing Wave Ratio; absolute value), the better the antenna performance. The value not more than 0.17 causes no problem in practical use.

Figure 2:
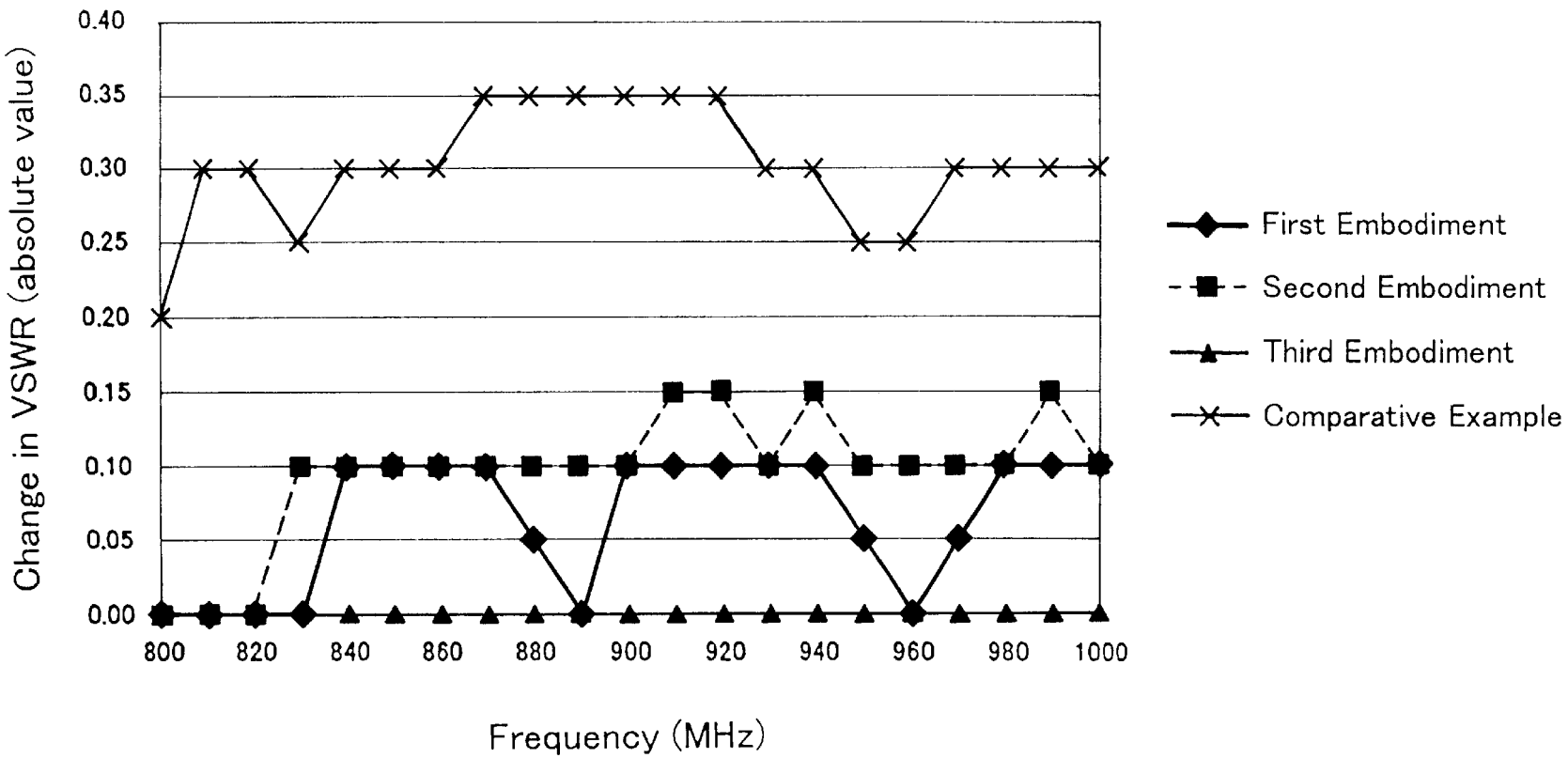
FIG. 2 is a graph showing the change in the antenna performance.

FIG. 2 shows changes in VSWR (absolute value) when the coaxial cable was moved. Also shown in this graph are those of second and third embodiments and comparative example below.

As is evident from FIG. 2, the largest change in VSWR in the antenna device of the first embodiment was 0.10. This shows that the change in the antenna performance due to the turning the position of the coaxial cable was small in this device.

According to the result of the first embodiment, when the ground pattern is connected to the coaxial cable in at least two connecting portions, the change in the antenna performance can be decreased.

Furthermore, change in the antenna performance can be decreased when the spacing between the connecting portions is substantially $\lambda/4$.

Second Embodiment

Figure 3:
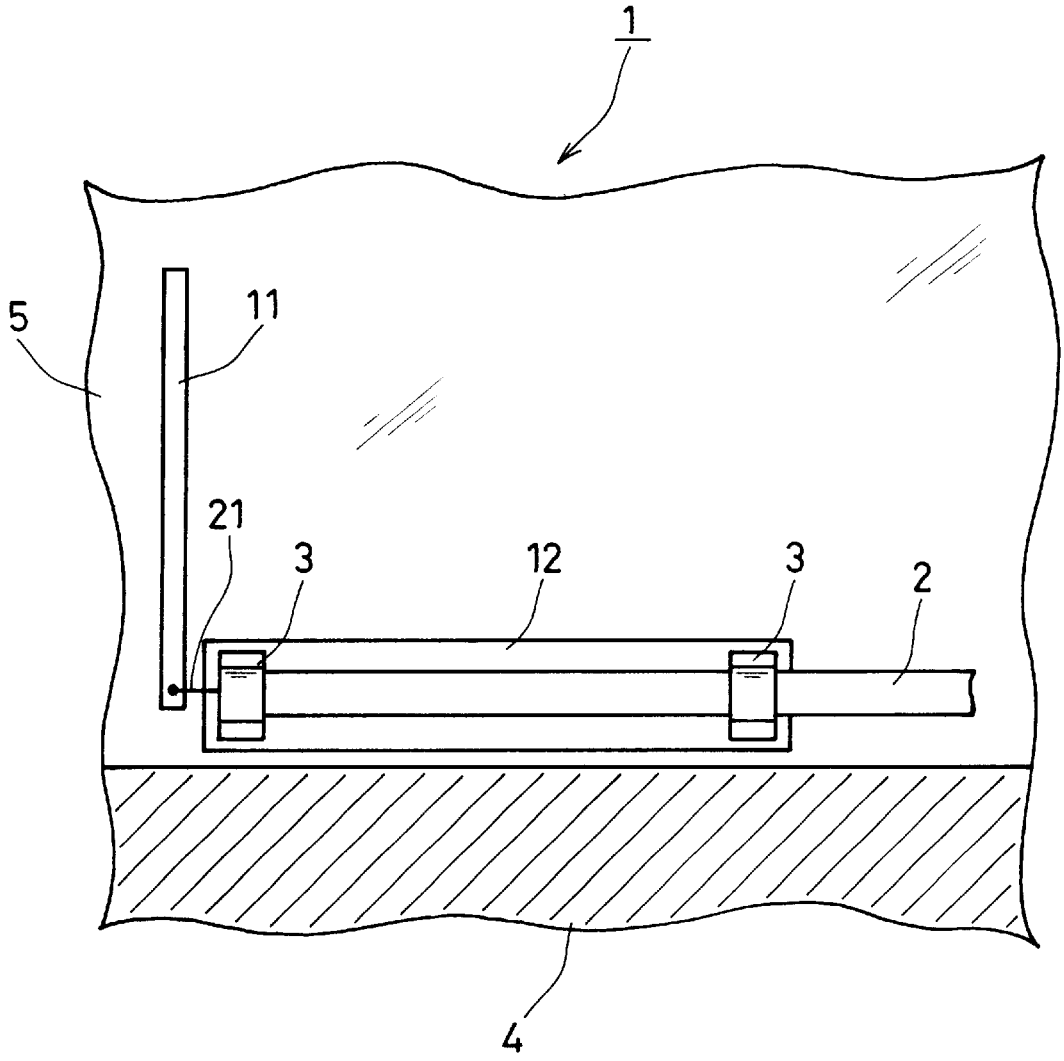
FIG. 3 is a plan view showing a second embodiment of the antenna device according to the present invention.

FIG. 3 shows an antenna device of a second embodiment of the present invention. In this second embodiment, half of the ground pattern of the first embodiment was removed, and other features were the same as in the first embodiment.

As is evident from FIG. 2, the largest change in VSWR in the antenna device of the second embodiment was 0.15. This shows that the change in the antenna performance due to the turning of the coaxial cable was small in this device.

A comparison between the results of the first and second embodiments shows that it is preferable that the ground pattern has a length of substantially $\lambda/2$ or longer in terms of antenna performance.

Third Embodiment

Figure 4:
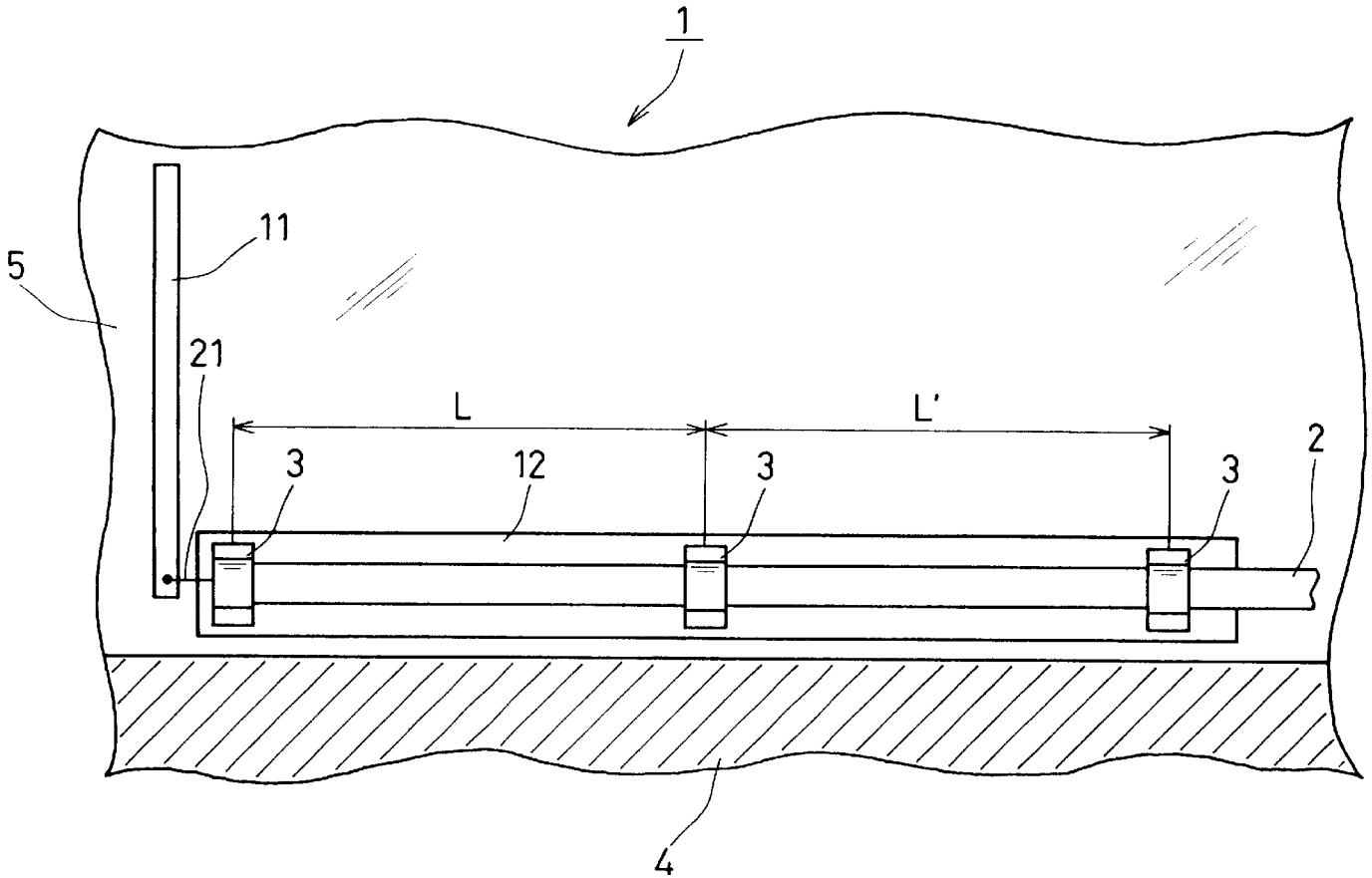
FIG. 4 is a plan view showing a third embodiment of the antenna device according to the present invention.

FIG. 4 shows an antenna device of a third embodiment of the present invention. This third embodiment is an example having three connecting portions. A ground pattern 12 and a braided wire that is the outer conductor of a coaxial cable 2 are connected and fixed with three metallic terminals 3. Each of the spaces L and L' is substantially $\lambda/4$.

As is evident from FIG. 2, there was no change in VSWR in the antenna device of the third embodiment. This shows that no change in the antenna performance was caused by the turning the position of the coaxial cable.

A comparison between the results of the second and third embodiments shows that it is preferable that the number of the connecting portions is three rather than two in terms of antenna performance.

Furthermore, a comparison between the results of the second and third embodiments also shows that it is preferable that the ground pattern has a length of substantially $\lambda/2$ or longer in terms of antenna performance.

APPLICATION EXAMPLE 1

Figure 5:
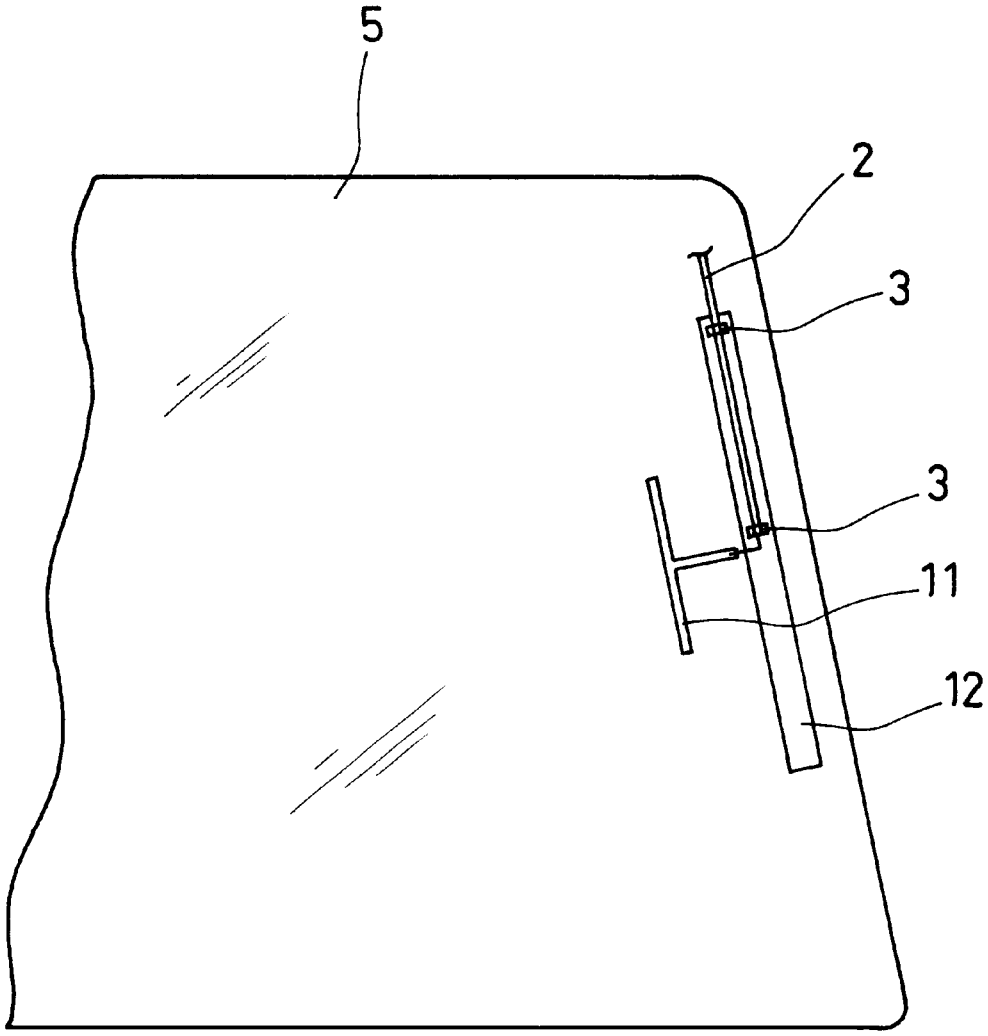
FIG. 5 is a plan view showing an application example of the first embodiment of the antenna device according to the present invention.

FIG. 5 shows an antenna device that is an application example of the first embodiment of the present invention. In this application example, the ground pattern 12 is mounted along a side edge of a glass plate 5, although the ground pattern 12 of the above first embodiment was mounted along the lower edge of the glass plate. Moreover, the radiation pattern 11 has a T-shape.

APPLICATION EXAMPLE 2

Figure 6:
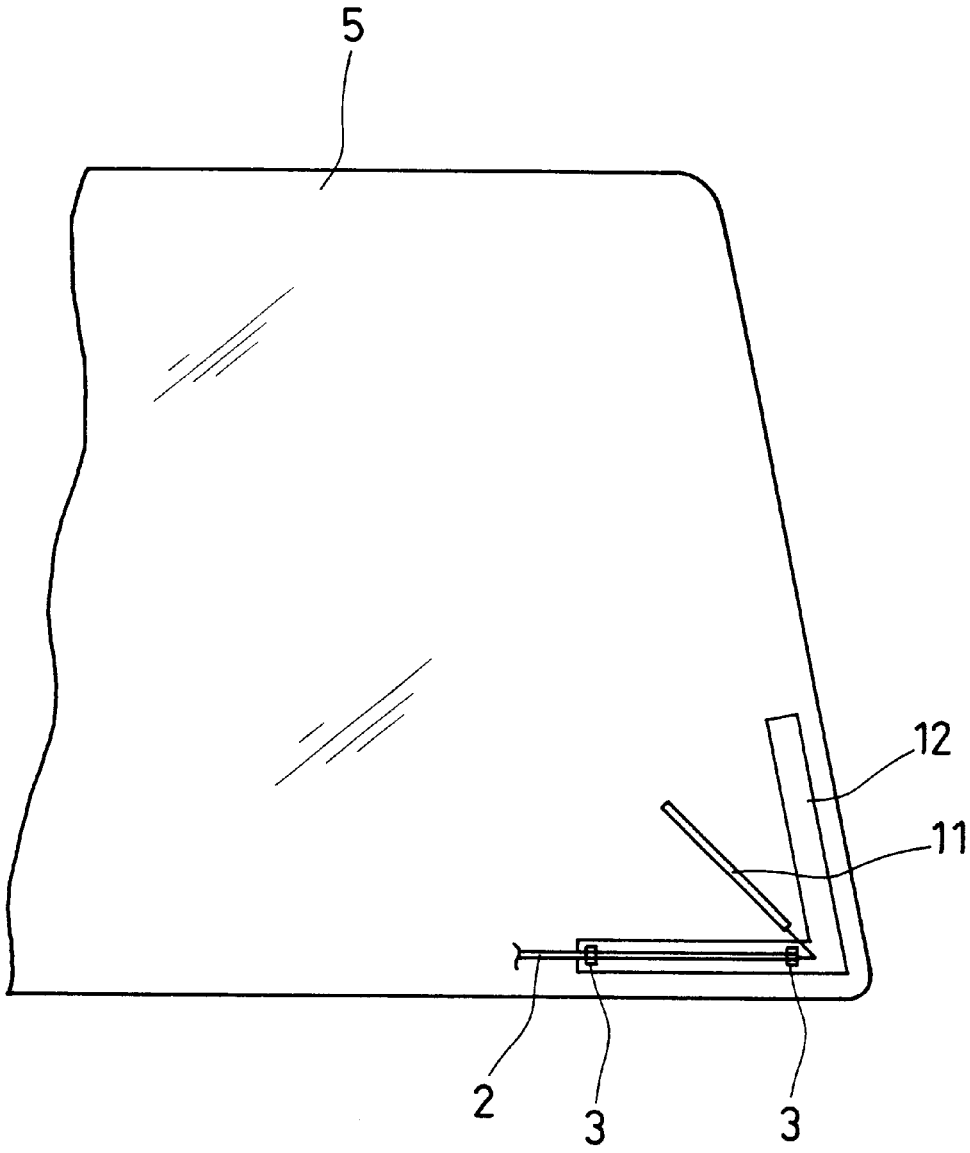
FIG. 6 is a plan view showing another application example of the first embodiment of the antenna device according to the present invention.

FIG. 6 shows an antenna device that is another application example of the first embodiment of the present invention. In this application example, the ground pattern 12 is mounted along a corner between the lower edge and a side edge of a glass plate, and has substantially an L-shape.

APPLICATION EXAMPLE 3

Figure 7:
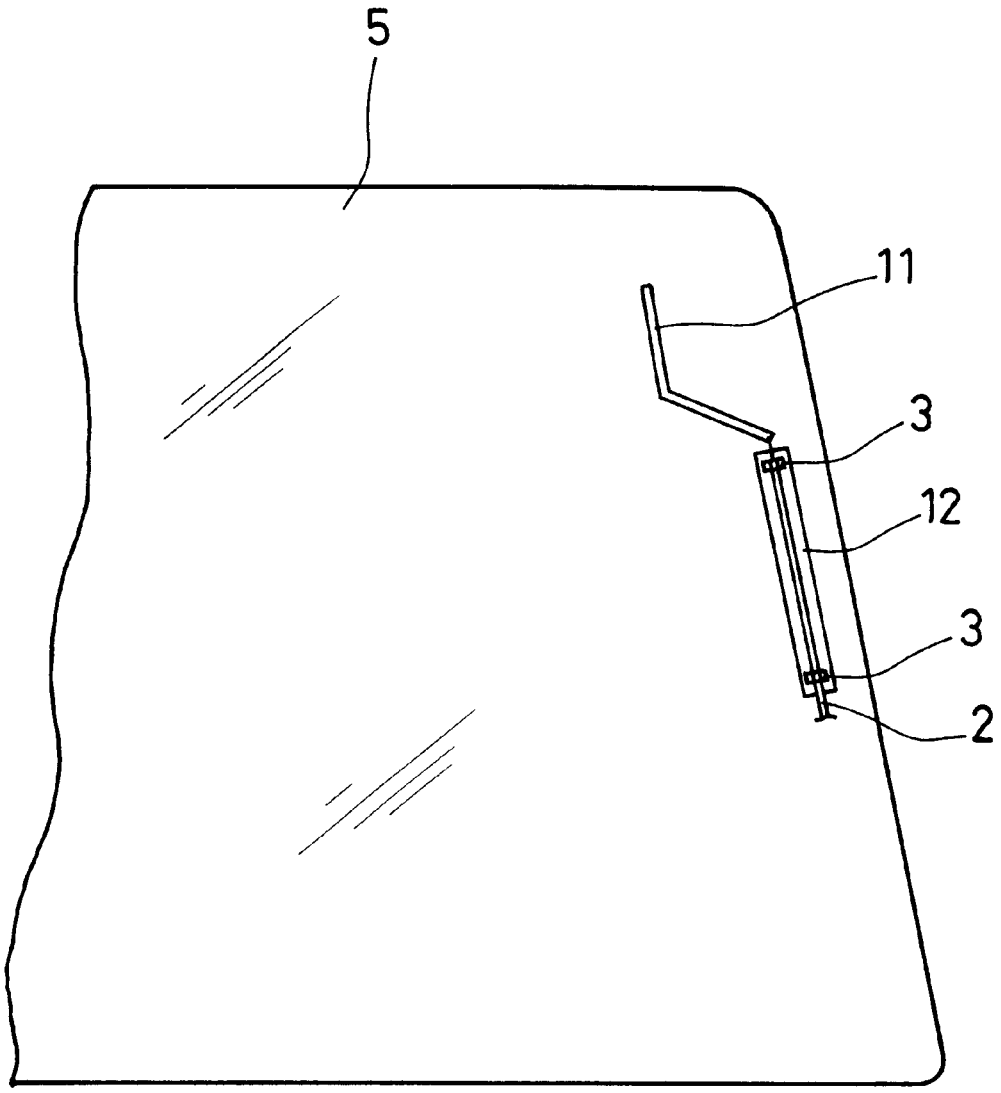
FIG. 7 is a plan view showing an application example of the second embodiment of the antenna device according to the present invention.

FIG. 7 shows an antenna device that is an application example of the second embodiment of the present invention. In this application example, the ground pattern 12 also is mounted along a side edge of a glass plate. Moreover, the radiation pattern 11 has substantially an L-shape.

Comparative Example 1

Figure 8:
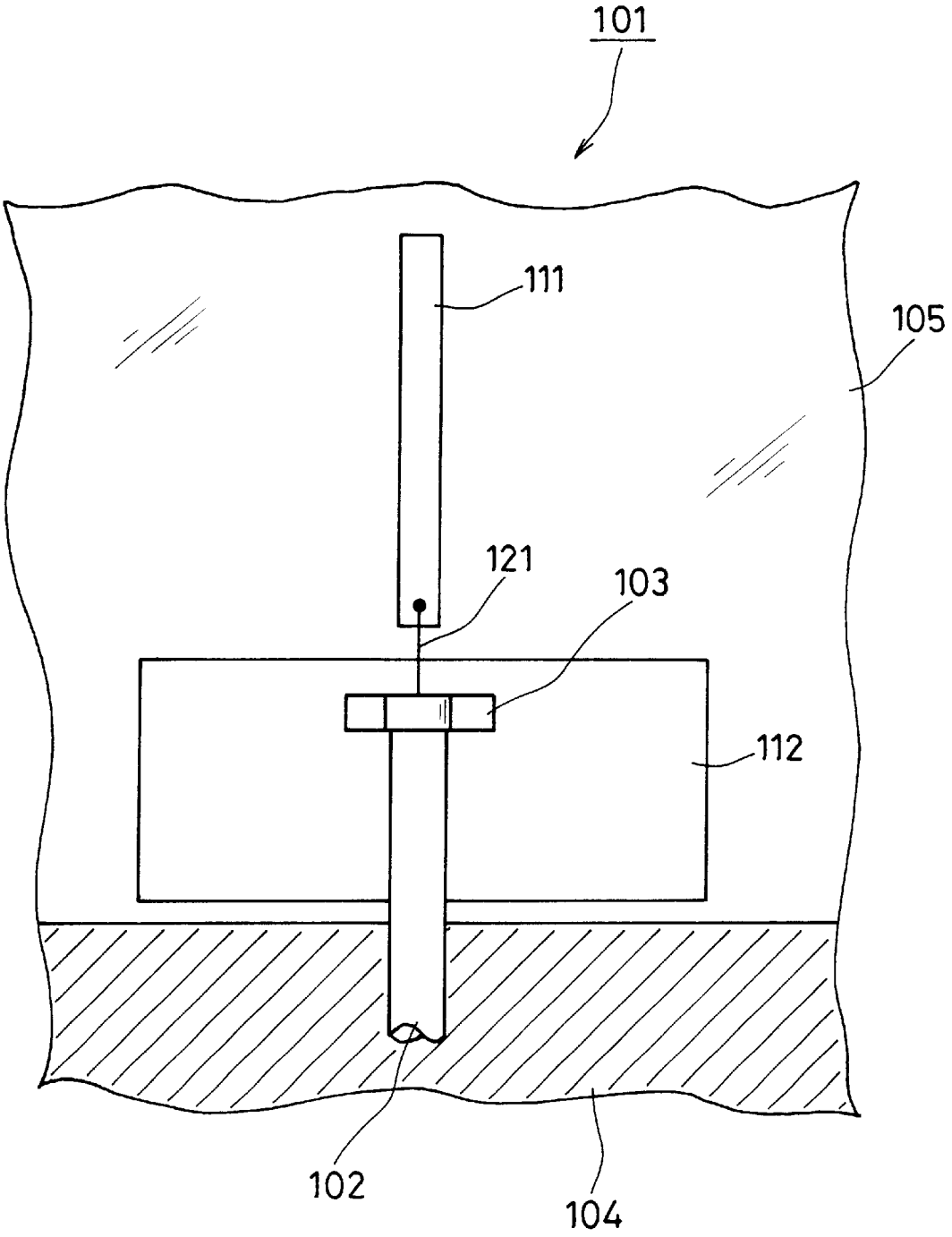
FIG. 8 PRIOR ART
FIG. 8 is a plan view showing a conventional antenna device for automobile telephones.

The antenna device shown in FIG. 8, which has been described as a prior art in the above, is herein indicated as a comparative example. The radiation pattern 111 is a linear pattern having a length of substantially λ/4 and is connected to the core 121 that is the inner conductor of the coaxial cable 102. The ground pattern 112 is a rectangular pattern having a vertical length of substantially λ/4 and a horizontal length of substantially λ/2.

The ground pattern 112 and a braided wire that is the outer conductor of the coaxial cable 102 are connected and fixed with a single metallic terminal 103. Furthermore, the metallic terminal 103 is soldered to the ground pattern 112.

In the antenna device of this Comparative Example 1, change in the antenna performance when the position of the coaxial cable was changed was measured in the same way as in the first embodiment. The result is also shown in FIG. 2. As is evident from FIG. 2, in the antenna device of this comparative example 1, the maximum change in VSWR was as large as 0.35. This shows that the change in the antenna performance due to the turning of the coaxial cable was large. That is, in this Comparative Example 1, the antenna performance was not stabilized because of the imperfect grounding.

The present invention has been described with reference to the above embodiments. Moreover, in the antenna device of the present invention, the shape of the radiation pattern is not particularly limited as long as it can transmit and receive the waves of intended wavelengths.

Moreover, at least the ground pattern is substantially band-shaped and has a sufficient width that enables the attachment of the metallic terminals so as to connect the ground pattern to the coaxial cable. If the width of the ground pattern is too large, the cost of the pattern material will be increased, and in addition, it will become a visual obstruction. Thus, it is desired that the width is kept within a suitable range.

The length L of the ground pattern is preferably at least larger than λ/4. It is more preferable that the length L is at least λ/2. Moreover, although there is no particular upper limit, if the length of the ground pattern is too large, the cost of the pattern material will increase, and in addition, it will become a visual obstruction. Thus, it is desired that the length is kept within a suitable range, particularly within the range of $L \leqq \lambda$.

The glass antenna device of the present invention also can be used for mobile communications.

Finally, it is understood that the invention may be embodied in other specific forms without departing from the spirit or essential characteristics thereof. The embodiments disclosed in this application are to be considered in all respects as illustrative and not restrictive, so that the scope of the invention being indicated by the appended claims rather than by the foregoing description, and all changes which come within the meaning and range of equivalency of the claims are intended to be embraced therein.

What is claimed is:

1. A glass antenna device mounted on a fixed window of a vehicle, comprising a radiation pattern and a ground pattern, the radiation pattern being connected to an inner conductor of a coaxial cable, the ground pattern being coupled capacitively with a body of the vehicle and further being connected to an outer conductor of the coaxial cable in at least two connecting portions;

wherein the connecting portions are provided in different portions with respect to a direction along the coaxial cable.

2. The glass antenna device according to claim 1, wherein a distance between two adjacent portions selected from the connecting portions is at least λ/4, where λ is a wavelength that is received or transmitted by the antenna device.

3. A glass antenna device according claim 2, wherein the distance is substantially λ/4.

4. The glass antenna device according to claim 1, wherein a number of the connecting portions is two.

5. The glass antenna device according to claim 1, wherein a number of the connecting portions is three.

6. The glass antenna device according to claim 1, wherein the ground pattern has a length of at least λ/2, where λ is a wavelength that is received or transmitted by the antenna device.

7. A glass antenna device according to claim 6, wherein the length is substantially λ/2.

* * * * *